US005288175A

United States Patent [19]

Knight

[11] Patent Number: 5,288,175

[45] Date of Patent: Feb. 22, 1994

[54] SEGMENTAL PRECAST CONCRETE UNDERPINNING PILE AND METHOD

[76] Inventor: David W. Knight, 1210 Hamblen Rd., Ste. 200, Kingwood, Tex. 77339

[21] Appl. No.: 832,840

[22] Filed: Feb. 10, 1992

[51] Int. Cl.[5] ..... E02D 5/30

[52] U.S. Cl. ..... 405/230; 405/251; 405/232

[58] Field of Search ..... 405/230, 229, 232, 251, 405/250, 256, 154, 166, 169; 52/127.1, 127.5, 127.12, 126.1, 514, 223.1, 223.11, 223.12; 254/134.3 SC, 134.3 R, 134.3 C, 134.3 FT

[56] References Cited

U.S. PATENT DOCUMENTS

| | | | |
|---|---|---|---|
| 563,130 | 6/1896 | Breuchaud | 405/230 |
| 580,226 | 4/1897 | Sanford | 405/170 |
| 996,397 | 6/1911 | Breuchaud | 405/230 X |
| 2,656,783 | 10/1953 | Riva | 405/184 |
| 2,946,560 | 7/1960 | Ferm | 254/134.3 FT |
| 3,270,362 | 9/1966 | Norton | 254/134.3 FT |
| 3,466,881 | 9/1969 | Lamy | 405/166 |
| 3,501,881 | 3/1970 | Van Buten | 52/223.4 |
| 4,627,769 | 12/1986 | Lee | 405/232 X |
| 4,796,865 | 1/1989 | Marchetti | 254/134.3 FT |

FOREIGN PATENT DOCUMENTS

| | | | |
|---|---|---|---|
| 0148920 | 8/1985 | Japan | 405/232 |

*Primary Examiner*—Dennis L. Taylor
*Attorney, Agent, or Firm*—Harrison & Egbert

[57] ABSTRACT

A continuously reinforced segmental precast concrete underpinning pile using a method of installation where a high strength strand aligns the precast segments during installation, provides a means for measurement of pile penetration depth, and continuously reinforces the pile when bonded or anchored upon completion.

13 Claims, 5 Drawing Sheets

SEGMENTAL PRECAST CONCRETE UNDERPINNING PILE AND METHOD

FIELD OF THE INVENTION

The invention relates to the repair of building foundations by underpinning. More specifically, it relates to a method for aligning pile segments during installation, inspecting pile penetration depth, and continuously reinforcing an improved segmental precast concrete pile used for underpinning repairs.

The Prior Art

There is a type of precast concrete pile used in the underpinning of building foundations comprised of vertically stacked, unconnected, precast concrete segments. These segments are pressed or driven vertically into the soil one at a time until adequate load capacity is obtained. This type of pile is distinctive in that it can be installed with almost no clearance, usually beneath an existing structure.

Although serviceable, this pile has several significant disadvantages: (a) the pile segments are not aligned, other than being stacked on each other, and detrimental misalignments can occur, (b) independent inspection of the installed pile depth is only possible by providing full-time inspection personnel during installation to monitor the quantity of precast segments used at each pile location, and (c) the completed pile is an unreinforced stack of precast concrete segments.

Misalignment of the segments as they are installed can produce several conditions detrimental to future pile stability. Lack of proper independent inspection of pile depth can lead to inadequate pile penetration, which in highly expansive soils produces an unstable installation subject to continued movements caused by seasonal changes in soil moisture. An unreinforced or non-continuously reinforced pile is subject to permanent separation at segment joints or breakage at segment midpoints when installed in clay soils having high shrink-swell potentials.

This separation of segments occurs when clay soils swell due to an increase in moisture content. This soil expansion exposes the pile to tension forces. This is especially detrimental to an unreinforced pile because even slight soil intrusion into the gaps between segments prevents closing of the gaps when soil moisture decreases. Over a period of years, this cyclical shrink-swell effect can lift the upper portion of the pile and the supported structure. This lifting effect at pile support locations falsely appears as settlement of adjacent unsupported areas.

SUMMARY OF THE INVENTION

Briefly, the invention provides a method for aligning precast concrete pile segments as they are installed, while furnishing a means for rapid inspection of pile installation depth, and upon completion of installation provides a continuously reinforced segmental precast concrete underpinning pile.

The above attributes are accomplished in the preferred embodiment by using a precast concrete starter segment with a graduated high strength steel strand extending from the center of one end. This starter segment is driven into the soil while using a bending template with a restraining anchor. The bending template curves and protects the strand, and the restraining anchor keeps the strand taut to prevent misalignment of the segments as they are driven. Improved precast concrete pile segments constructed with strand ways are then threaded onto the graduated strand and aligned for installation in the same manner as the starter segment.

Installation of subsequent segments continues until adequate load capacity and depth is obtained. Upon completion of segment installation, a pile cap is threaded onto the strand for distributing structural loads to the pile. The pile penetration depth can be easily inspected upon completion by simply reading the graduated strand. After inspection of the pile penetration depth, the excess length of strand is trimmed flush. The annular space between strand and concrete is then injected with a structural adhesive to bond all components of the pile.

This method of installation provides an aligned, continuously reinforced, concrete underpinning pile of verifiable depth, installed under conditions with almost no clearance, such as beneath an existing building.

DETAILED DESCRIPTION OF THE INVENTION

The invention is particularly well suited for use in underpinning buildings in areas plagued with problematic soil conditions such as expansive clays, poorly compacted fill soils, loose sands or silts, and high or perched water tables. The invention is a significant improvement of the prior art, which has remained mostly unchanged for the last 15-years.

Figure 1:
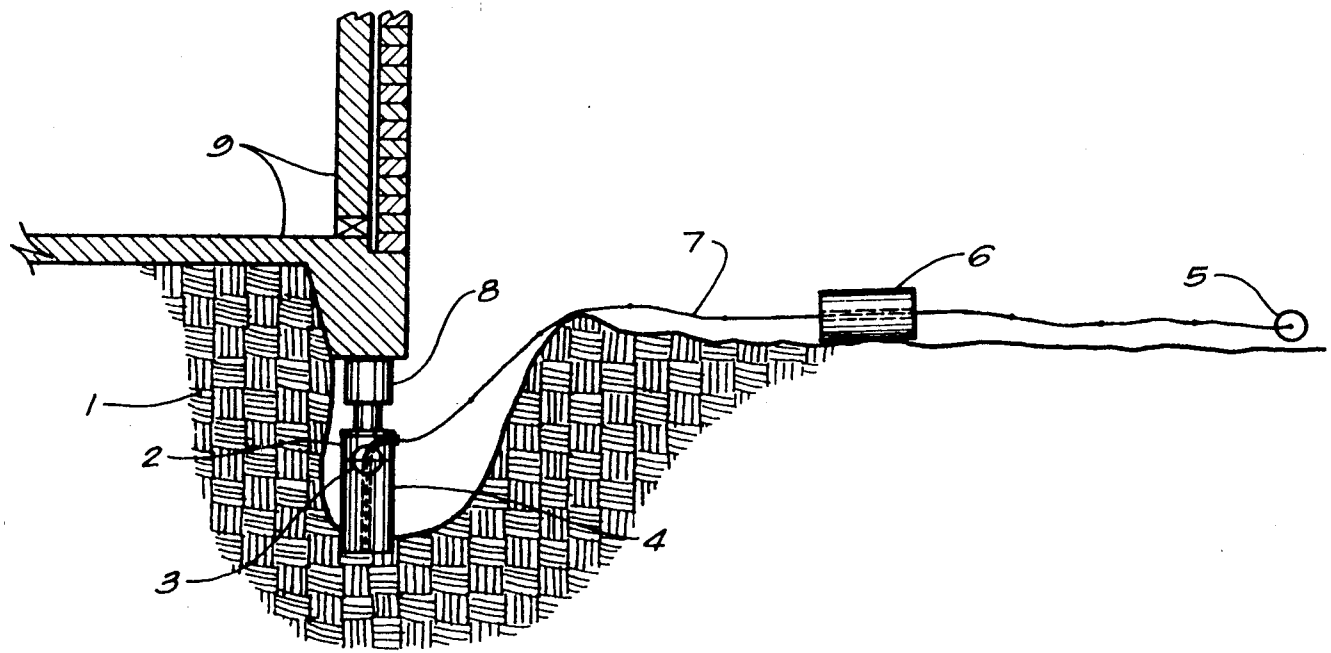
FIG. 1: A side view of the preferred embodiment show%g the initial stages of installation beneath the perimeter of an existing structure.
Figure 2:
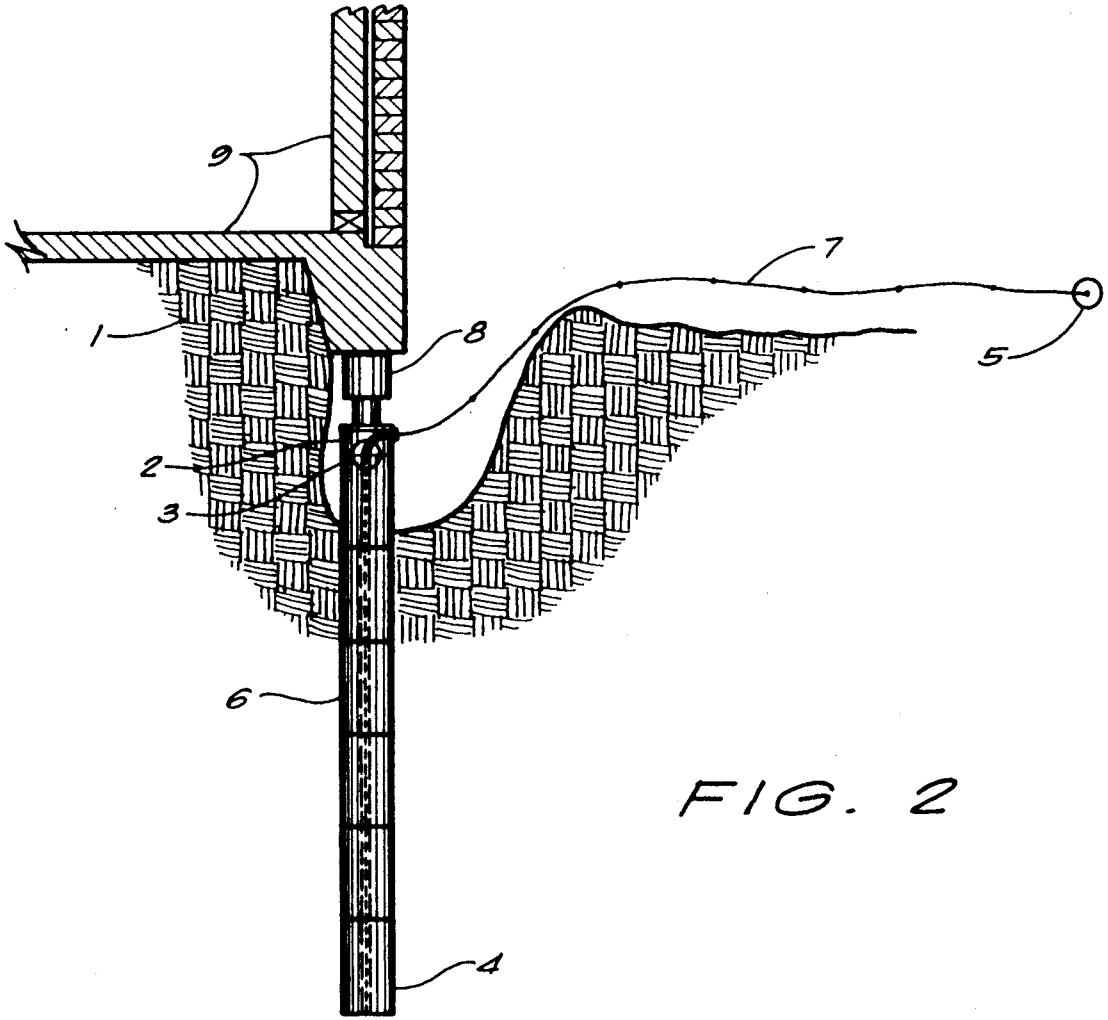
FIG. 2: A side view of the preferred embodiment show%g partial completion of segment installation.
Figure 7:
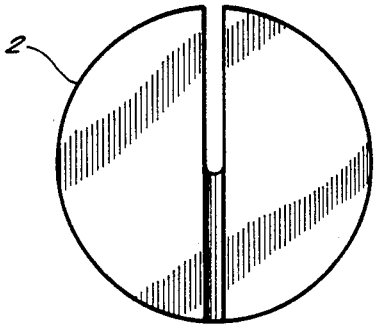
FIG. 7: A plan view of the bending template used in the preferred embodiment.
Figure 8:
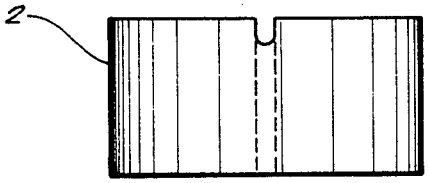
FIG. 8: A front view of the bending template.
Figure 9:
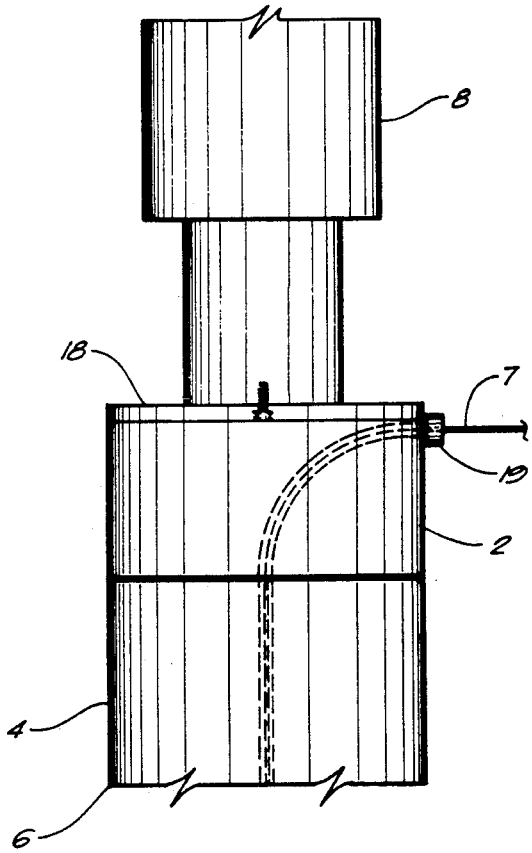
FIG. 9: A side view of the bending template shown during the installation process.

FIGS. 1 and 2 are side views showing the preferred embodiment of the invention in the initial, and intermediate stages of installation, where a hydraulic jack (8) presses the pile segments (4 and 6) into the soil (1). A bending template (2) is positioned between the hydraulic jack and the pile segments to bend and protect the graduated strand (7) from damage, see FIGS. 7 through 9. A flat plate (18) is used on the piston of the hydraulic jack to hold the strand in the bending template, and a retaining anchor (19) is used to keep the strand taut to prevent misalignments. Multiple pile segments (6) are sequentially threaded onto the strand for installation. The depth of pile penetration can be inspected by reading the strand marker at the point of installation (3), or may be calculated by measuring the length of strand remaining from the tip marker (5) and subtracting that length from the calibrated strand length.

Figure 3:
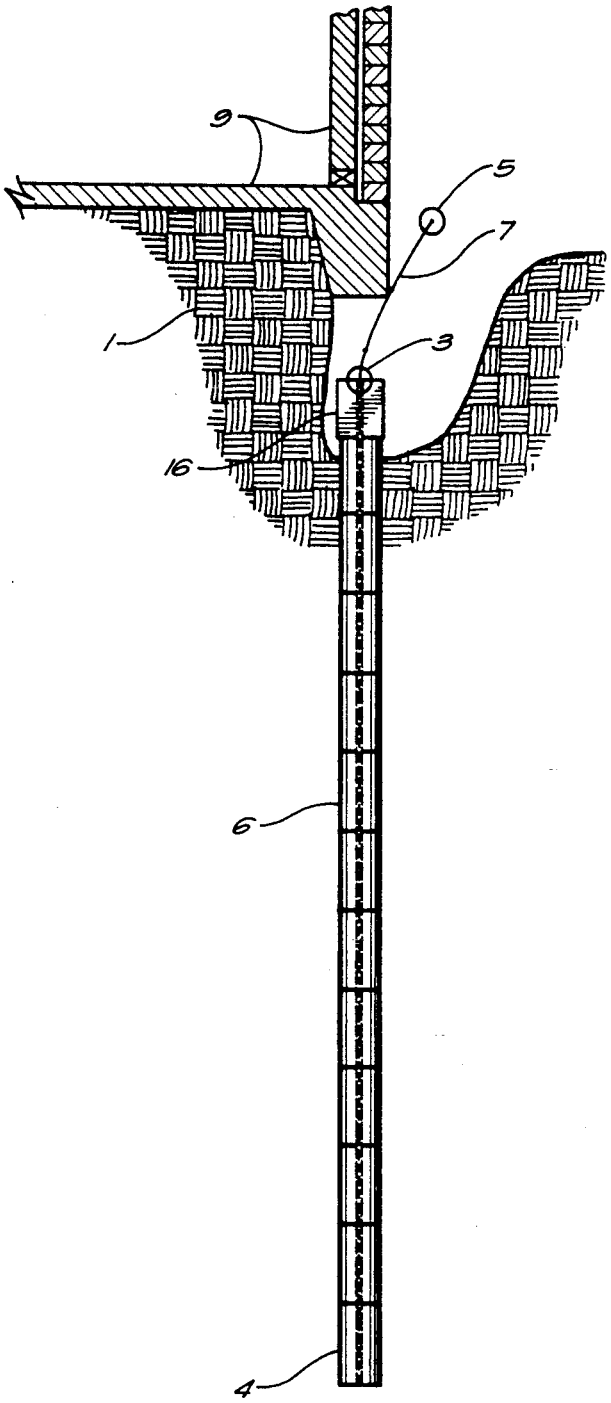
FIG. 3: A side view of the preferred embodiment showing the segment and cap installation complete.
Figure 4:
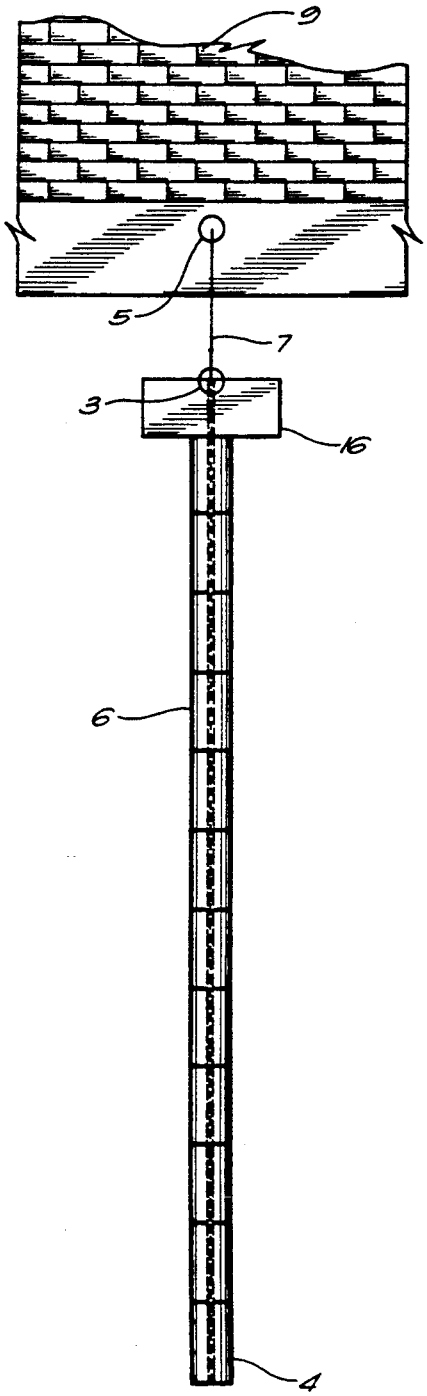
FIG. 4: A front view of the preferred embodiment showing the segment and cap installation complete.

FIGS. 3 and 4 are side and front views, respectively, of the preferred embodiment with the installation of segments complete. A pile cap (16) has been threaded onto the installed pile segments for support and transfer of structural loads to the pile. Ideally the depth of pile penetration is inspected when the pile reaches this point of completion.

Figure 5:
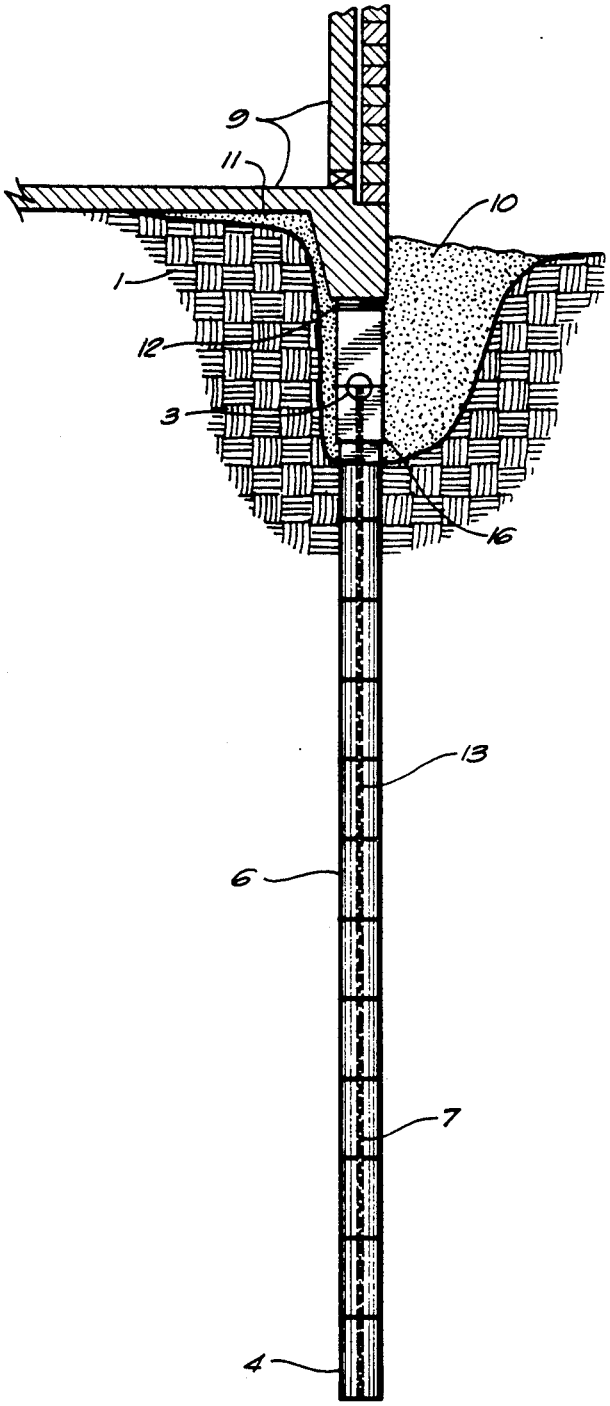
FIG. 5: A side view of the preferred embodiment shown supporting the structure in a completed and final condition.
Figure 6:
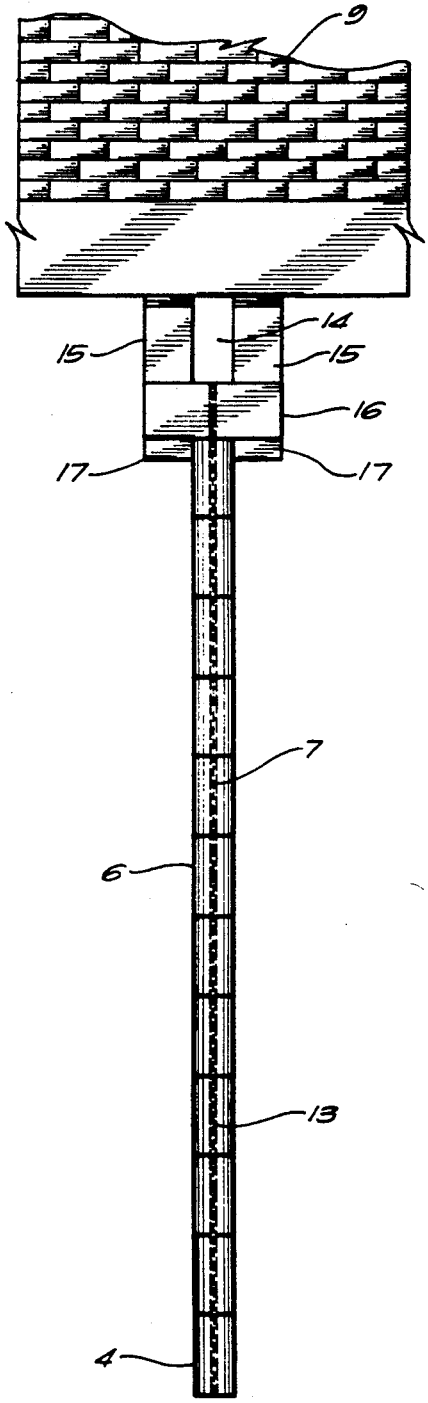
FIG. 6: A front view of the preferred embodiment shown supporting the structure in a completed and final condition.

FIGS. 5 and 6 are side and front views, respectively, of the preferred embodiment showing the completed installation beneath the perimeter of an existing structure (9). The graduated strand has been trimmed flush at the point of installation (3), and the annular spare between strand and concrete (13) has been injected with a structural adhesive. This completed installation incorporates void spaces (17) beneath the pile cap (16) to reduce the possibility of damage due to swelling or heaving of clay soils.

The underpinning operation is completed upon lifting (11) and shimming (12) between the support blocks (15) and the existing structure (9). Lifting is done with jacks placed in the space (14) between the support blocks (15). The underpinning installation is then backfilled with soil fill (10).

The preferred embodiment uses a starter segment (4) manufactured with a graduated high strength steel strand (7) anchored and extending from the center of one end. Improved pile segments (6) and a pile cap (16), all manufactured with strand ways, are also used. The segments (4 and 6) are typically precast concrete, either circular or square in cross-section, and are usually 1-ft. in height, while the strand (7) is typically high strength steel. The strand may be anchored or bonded within the starter segment in several ways. In the preferred embodiment, the strand is embedded and bonded to fresh concrete during manufacture of the starter segment by using a 2-component epoxy bonding agent. The pile cap (16) is typically precast of steel fiber reinforced concrete, and can be of many possible configurations. It is shown as a rectangular prism with the strand way formed through the short dimension at the midpoint of the long dimension. A structural adhesive (13), typically a 2-component epoxy, is used to bond the steel strand to the concrete components throughout the pile length.

The adhesive used is dependent upon site conditions, and more specifically on the water table, but may range from a low viscosity adhesive used after installation of all the segments is complete, to a high viscosity adhesive used after each individual segment has been installed. Typically, a low viscosity adhesive injected after all segments have been installed will thoroughly penetrate and bond the entire annular space as well as the joints between segments.

The dimensions and reinforcing requirements of the pile are site specific, and depend primarily on the soil conditions and structural loads needing to be supported. Site soil conditions are typically investigated by a Geotechnical Engineer who submits pile capacity and penetration recommendations to the Structural Engineer, who then sizes the piles and determines support locations based on the loads needing to be supported.

The diameter or width of a segment (4 and 6) is commonly 6-inches, with the segment being precast of concrete having a minimum compressive strength of 3000-psi. The graduated strand (7) is typically of high strength steel having a 270-ksi yield strength, with calibrated steel markers (5) fabricated onto the strand and highlighted with paint. The structural adhesive (13) is usually a 2-component epoxy having a minimum compressive strength of 6,000-psi and a minimum bond strength of 1000-psi, such as an ASTM C-881, Type VI bonding system. Normal penetration requirements range from a minimum of about 7-ft., up to possibly 20-ft. or more, with most installations being around 12-ft.

Installation equipment typically consists of incidental hand tools to excavate access tunnels or holes, a hydraulic jack with an electric pump, and a bending template (2) to bend and protect the strand during installation. The bending template is typically a cylinder or block having an internal guide of an appropriate radius to bend and protect the strand being used, see FIGS. 7 through 9. It is fabricated so that the strand can be quickly inserted into the guide. The bending template can be fabricated of any material reasonably able to withstand wear such as aluminum, steel and some polymers. Additionally, a restraining anchor is used during driving of the segments to keep the strand taut.

Typical underpinning operations usually have only limited clearance, or head room, and support locations will be beneath the perimeter or interior of a building, see FIGS. 1 through 6. The invention allows for installation under these conditions because the precast components and equipment are small in nature, and the graduated strand (7) is flexible and can curve to a near horizontal position while the pile segments (4 and 6) are being installed vertically, see FIGS. 1 and 2.

The invention provides a completed pile that is equivalent to a one piece, steel reinforced, precast concrete pile of the same dimensions. A one piece precast concrete pile is rarely used for underpinning because it requires heavy equipment to install, and is impossible to install beneath an existing building without requiring an exorbitant amount of demolition to provide adequate clearance.

Some anticipated variations of the preferred embodiment are: (a) strands of some material other than high strength steel, (b) multiple internal strands, (e) multiple external strands, (d) the use of permanent mechanical anchoring at the ends of the strands, and (e) tensioning of the strands prior to permanent mechanical anchoring. The foregoing disclosure and description of the invention is explanatory and illustrative thereof. Variations of the illustrated construction or in the steps of the described method may be made within the scope of the appended claims without departing from the spirit of the present invention. The present invention should only be limited by the following claims and their legal equivalents.

I claim:

1. A process of installing segmented underpinning piles for supporting a structure upon the earth comprising the steps of:

driving a first pile segment into unexcavated earth a desired distance from said structure, said first pile segment having an end of a strand fixedly received therein, said strand extending outwardly from an end of said first pile segment;

sliding a second pile segment on said strand until said second pile segment contacts said end of said first pile segment; and driving said second pile segment another desired distance into the earth.

2. The process of claim 1, further comprising the step of:

affixing one end of said strand into said first pile segment, said strand extending through said second pile segment.

3. The process of claim 1, further comprising the steps of:

forming a hole extending longitudinally through said second pile segment; and threading said second pile segment onto said strand prior to the step of sliding.

4. The process of claim 1, said step of sliding comprising:

moving said second pile segment along said strand until said second pile segment is vertically aligned with said first pile segment, said second pile segment having an end surface in surface to surface contact with said end of said first pile segment.

5. The process of claim 1, further comprising the step of:

positioning a bending template on said end of said first pile segment prior to the step of driving said first pile segment, said strand extending angularly through said bending template, said bending template having a surface in contact with said end of said first pile segment.

6. The process of claim 5, further comprising the steps of:

removing said bending template from said strand after said step of driving said first pile segment; and repositioning said bending template onto said end surface of said second pile segment opposite said first pile segment, said step of repositioning being before said step of driving said second pile segment.

7. The process of claim 1, further comprising the steps of:

positioning a cap member between the structure and said second pile segment; and affixing a support member on a side of said cap member opposite said pile segments, said support member for abutment with said structure.

8. The process of claim 3, further comprising the steps of:

injecting a structural adhesive into the space between said hole and said strand; and solidifying said structural adhesive so as to secure said strand to said second pile segment.

9. The process of claim 7, further comprising the step of:

trimming said strand following the positioning said cap member.

10. The process of claim 9, further comprising the step of:

tensioning said strand prior to the step of trimming.

11. The process of claim 1, further comprising the steps of:

removing a volume of earth from beneath a portion of the structure;

positioning said first pile segment below said portion of said structure; and placing a jack between said first pile segment and said portion of said structure.

12. The process of claim 1, further comprising the step of:

interposing a bending template between said end of said first pile segment and said jack, said bending template for angularly deflecting said strand from said jack.

13. The process of claim 2, further comprising the step of:

marking said strand with indicators corresponding to a length of measurement.

* * * * *